US011306571B2

(12) United States Patent
Jiang et al.

(10) Patent No.: US 11,306,571 B2
(45) Date of Patent: Apr. 19, 2022

(54) METHOD FOR INJECTING NON-CONDENSABLE GAS OR IN-SITU COMBUSTION TO RECOVER REMAINING OIL IN A HEAVY OIL RESERVOIR WITH BOTTOM WATER

(71) Applicants: Southwest Petroleum University, Sichuan (CN); Heavy Oil Development Institute, Liaohe Oilfield Exploration and Development Research Institute, PetroChina Oilfield, Liaoning (CN)

(72) Inventors: Qi Jiang, Chengdu (CN); Changhao Hu, Chengdu (CN); Zhongyuan Wang, Chengdu (CN); Siyuan Huang, Chengdu (CN); Zhibin Wang, Chengdu (CN); Dong Wang, Chengdu (CN)

(73) Assignees: SOUTHWEST PETROLEUM UNIVERSITY, Chengdu (CN); HEAVY OIL DEVELOPMENT INSTITUTE, LIAOHE OILFIELD EXPLORATION AND DEVELOPMENT RESEARCH INSTITUTE PETROCHINA OILFIELD, Panjin (CN)

( * ) Notice: Subject to any disclaimer, the term of this patent is extended or adjusted under 35 U.S.C. 154(b) by 0 days.

(21) Appl. No.: 16/823,665

(22) Filed: Mar. 19, 2020

(65) Prior Publication Data

US 2020/0300069 A1 Sep. 24, 2020
US 2021/0262331 A9 Aug. 26, 2021

(30) Foreign Application Priority Data

Mar. 19, 2019 (CN) ..... 201910205839.1

(51) Int. Cl.
*E21B 43/243* (2006.01)
*E21B 43/16* (2006.01)
*E21B 43/24* (2006.01)

(52) U.S. Cl.
CPC ..... *E21B 43/243* (2013.01); *E21B 43/168* (2013.01); *E21B 43/24* (2013.01); *E21B 43/2401* (2013.01)

(58) Field of Classification Search
None
See application file for complete search history.

(56) References Cited

U.S. PATENT DOCUMENTS

2009/0178806 A1* 7/2009 Fraim ..... E21B 43/243 166/270.1
2009/0260811 A1* 10/2009 Cui ..... E21B 36/02 166/272.3

(Continued)

*Primary Examiner* — Andrew Sue-Ako
(74) *Attorney, Agent, or Firm* — Onello & Mello, LLP

(57) ABSTRACT

A method for injecting non-condensable gas or application of in-situ combustion to recover remaining oil in a heavy oil reservoir with bottom water includes: drilling a new horizontal well in an oil layer between the existing horizontal production well location and the bottom water layer; preheating the new horizontal well; after the horizontal section of the horizontal well is in thermal communication with the upper steam/gas chamber, performing gas injection in existing wells to maintain pressure slightly higher or similar to the pressure of the bottom water layer, and converting the horizontal well into a continuous production well; drilling a vertical well in the unswept reservoir area; establishing a fluid communication in the oil layer between the vertical well and the horizontal well, injecting air or oxygen into the vertical well; and in the later stage of the horizontal well, stopping gas injection and gradually reducing the pressure in the steam/gas chamber.

7 Claims, 3 Drawing Sheets

(56) References Cited

U.S. PATENT DOCUMENTS

| | | | | |
|---|---|---|---|---|
| 2011/0315386 | A1* | 12/2011 | Dusseault | E21B 41/0064<br>166/305.1 |
| 2013/0118737 | A1* | 5/2013 | Schneider | E21B 43/2405<br>166/272.3 |
| 2013/0248177 | A1* | 9/2013 | Kerr | C10G 1/002<br>166/272.3 |
| 2015/0176382 | A1* | 6/2015 | Chakrabarty | E21B 43/30<br>166/252.5 |

* cited by examiner

Block-shaped bottom water reservoir (cold 41-block Shasan section)

Block-shaped bottom water and gas cap reservoir (high 2 and 3-area Lianhua Oil Layer)

Block-shaped side, bottom, and top water reservoir (Shuyi Area Guantao Group)

Block-shaped bottom water reservoir (Shuyi Area Xing VI Group)

METHOD FOR INJECTING NON-CONDENSABLE GAS OR IN-SITU COMBUSTION TO RECOVER REMAINING OIL IN A HEAVY OIL RESERVOIR WITH BOTTOM WATER

CROSS REFERENCE TO RELATED APPLICATIONS

The present application claims the benefit of priority under 35 USC 119 to Chinese patent application 201910205839.1, filed Mar. 19, 2019, the contents of which are incorporated herein by reference.

TECHNICAL FIELD

The present invention relates to a method for injecting non-condensable gas or in-situ combustion to recover remaining oil in a heavy oil reservoir with bottom water.

BACKGROUND

The type of heavy oil reservoirs with bottom water is very common. At present, most of the heavy oil reservoirs that carry out steam injection thermal recovery in Liaohe Oilfield, China, are medium-deep buried with thick bottom water (as shown in FIG. 1). The dark grey section in the figure is an oil layer, and the light gray section is a water layer. In these reservoirs, a vertical well steam "huff and puff" producing method is mainly used. Some reservoirs have also switched to a steam flooding or steam-assisted gravity drainage (SAGD) producing method in the later stage of steam huff and puff.

Steam huff and puff relies on the steam injected into the near-well zone to heat the oil layer, to reduce the viscosity of the crude oil, and then lift the mixture of crude oil and steam condensate to the ground. When the formation temperature decreases to the point where the oil production cannot reach economic production, a steam slug is injected into the formation. When the pressure and temperature in the near-well zone increases, the well is opened for production.

This production process is repeatedly applied for multiple cycles until the cycle production effect is below the economic limit. With the progress of the production process, the pressure of the producing layer decreases with the huff and puff cycle. Because the pressure of the bottom water layer is high, due to the pressure difference between the bottom water layer and the production layer, the bottom water tends to flow upward. Once the bottom water breaks into the production intervals, the thermal efficiency from steam injection will be greatly reduced. In severe cases, production wells will be shut down and the development efficiency of the entire reservoir will be affected. In order to prevent or avoid the bottom water from breaking into the production well during normal operations, a part of the oil layer thickness (10-20 meters) is generally reserved in the lower part of the reservoir as a barrier for preventing the bottom water from coming into the production interval. Therefore, at the end of the development of the huff and puff, a considerable proportion of the unused oil layer will be left above the bottom water layer.

SUMMARY

The inventive concepts mainly overcome the shortcomings in the prior art, and propose a method for injecting non-condensable gas or application of in-situ combustion to recover remaining oil in a heavy oil reservoir with bottom water.

An embodiment of a technical solution provided by the inventive concepts for solving the above technical problems is: a method for injecting non-condensable gas or in-situ combustion to recover remaining oil in a heavy oil reservoir with bottom water.

Embodiments of the method comprises drilling a new horizontal well in an oil layer between the existing horizontal production well location and the top of bottom water layer and preheating the new horizontal well. Wherein during the preheating stage, the operating pressure at the bottom hole of the new horizontal well is equal to the pressure of the water layer to prevent the injected fluid from entering the bottom water layer. Meanwhile, the method also includes using the original vertical gas injection well to inject air or flue gas into the existing steam chamber, and increasing the pressure in the steam chamber to the same as the bottom water pressure. After the horizontal section of the new horizontal well is in thermal communication with the upper steam/gas chamber, convert the new horizontal well into a continuous production well; shutting in the original upper horizontal well when steam/gas chamber is too low. The method also includes, after the initial stage of the production of the new horizontal well, drilling a new vertical well in the unswept reservoir area, wherein the newly drilled vertical well and the new horizontal well form a new pair of vertical well and horizontal well combination. The method includes, after achieving fluid communication in the oil layer between the new vertical well and the new horizontal well, injecting air or oxygen into the vertical well to create combustion condition underground, and producing the heated crude oil and combustion gas from the new horizontal well. And the method includes, when the horizontal well enters the later stage, stopping gas injection and gradually reducing the pressure in the steam/gas chamber until the end of oil production.

In various embodiments, a further technical solution is that the horizontal section of the horizontal well is placed in the oil layer having a distance of 2-5 meters above the top of the bottom water layer.

In various embodiments, a further technical solution is that the preheating is performed by any of steam circulation, electric heating, solvent injecting, or the combination thereof.

In various embodiments, a further technical solution is that, in the initial stage of the production of a new horizontal well, the initial pressure of the steam/gas chamber is higher than the pressure of the bottom water layer by 300-500 kPa, in order to push the upper preheated crude oil to the lower horizontal well. And after the stable production is reached, the pressure in the steam/gas chamber is controlled at the balanced pressure level of the bottom water layer.

In various embodiments, a further technical solution is that the distance between the vertical well and the toe of the horizontal well is 5-10 meters, and the distance between the bottom boundary of the perforation interval of the vertical well and the toe level of the horizontal well is 3-5 meters.

A further technical solution is that a fluid communication is established in the oil layer between the vertical well and the horizontal well by any means of thermal circulation, injection of light oil, injection of chemical solvents, injection of a viscosity reducer, or electric heating.

In various embodiments, a further technical solution is that the pressure of the horizontal well is kept equal to the pressure of the bottom water layer during the entire fluid communication process, reducing the risk of bottom water invading a production well and a steam/gas chamber.

The present invention has the following advantages: the present invention produces the remaining oil below the current horizontal well and near the toe, which greatly improves the ultimate recovery of heavy oil reservoirs with strong bottom water.

DETAILED DESCRIPTION

The inventive concepts will be further described below with reference to the embodiments and the accompanying drawings.

Embodiment 1

As shown in FIGS. 2-5, a method for injecting non-condensable gas or application of in-situ combustion to recover remaining oil in a heavy oil reservoir with bottom water according to the present invention comprises the following steps.

In a first step, the method includes drilling a new horizontal well in an oil layer between the existing horizontal production well location and the bottom water layer, wherein the horizontal well is located in the oil layer having a distance of 2-5 meters above the top of the bottom water layer.

In a second step, the method includes preheating the new horizontal well by any of steam circulation, electric heating, solvent injecting or the combination thereof, wherein during the preheating stage, the operating pressure at the bottom of the well is equal to the pressure of the water layer to prevent the injected fluid from entering the bottom water layer; meanwhile, using the original vertical gas injection well to inject air or flue gas into the steam/gas chamber, and increasing the pressure in the steam/gas chamber to the same as the bottom water pressure.

Figure 1:
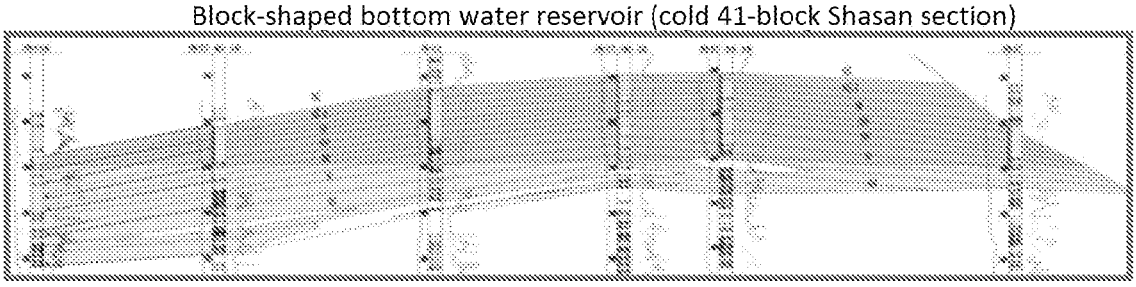
FIG. 1 is a vertical cross-section diagram of a medium-deep heavy oil reservoir with bottom water in Liaohe Oilfield, China.
Figure 1:
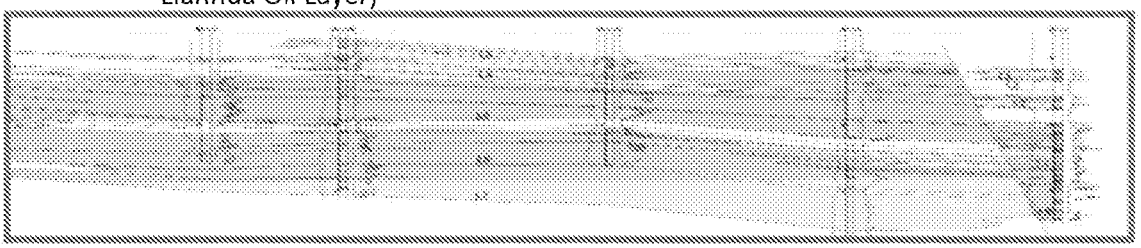
Figure 1:
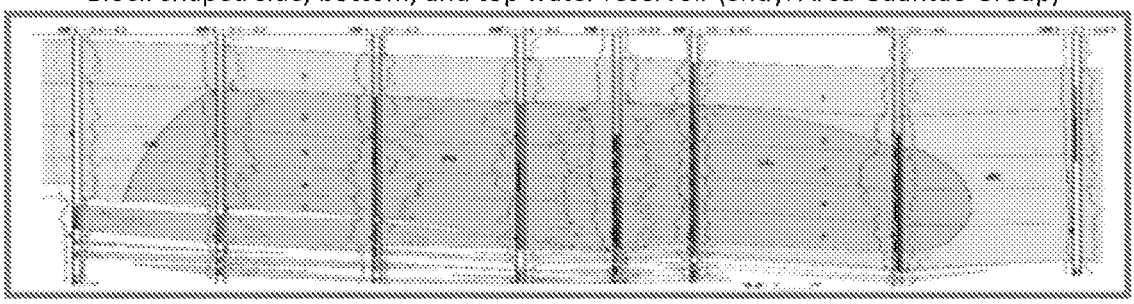
Figure 1:
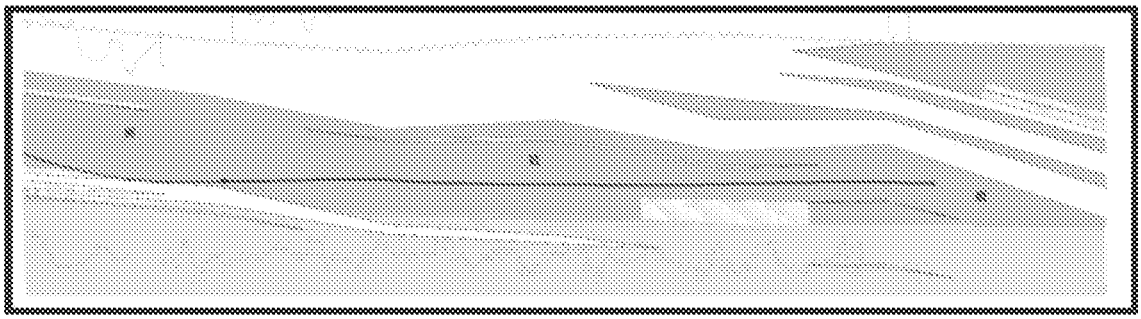
Figure 2:
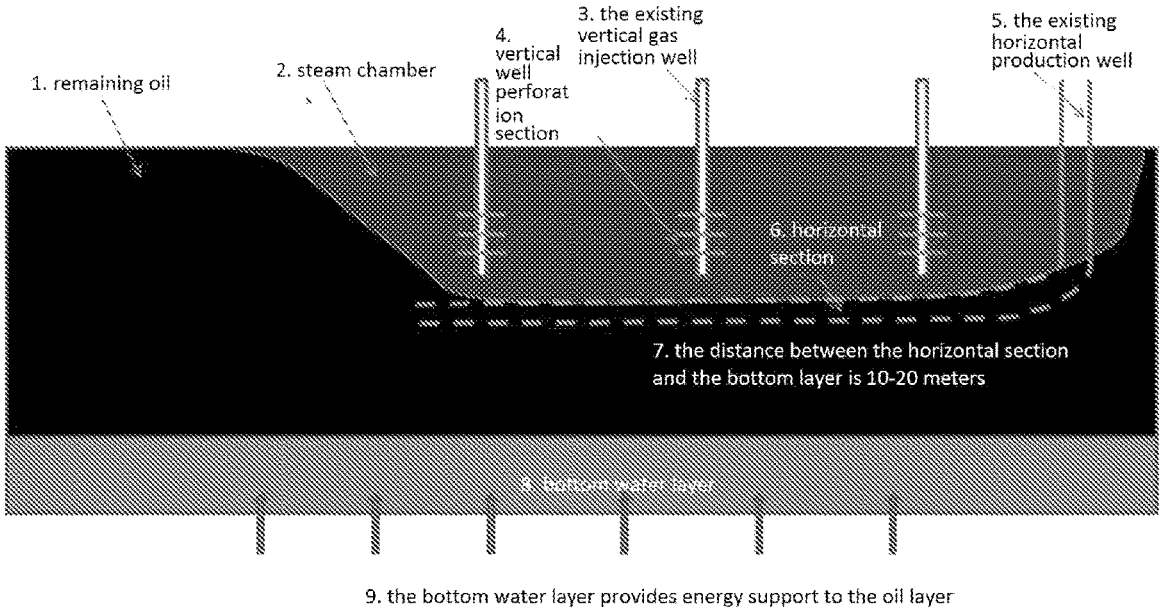
FIG. 2 is a schematic diagram of the remaining oil distribution in a combined gravity drainage production method of a vertical well and a horizontal well in a bottom water reservoir.
Figure 3:
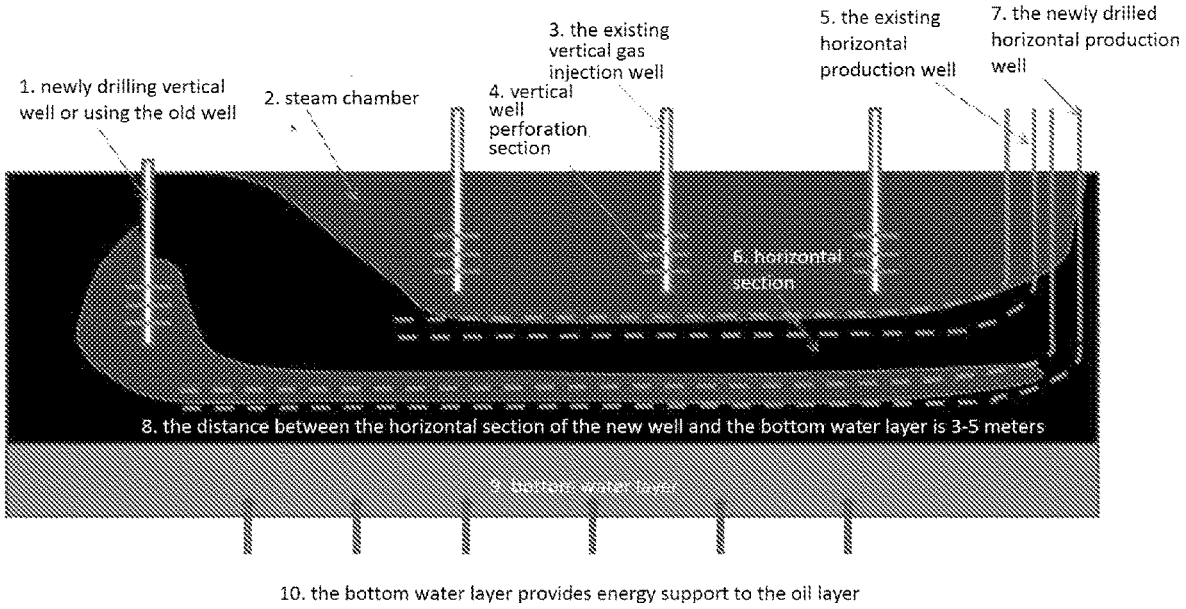
FIG. 3 is a schematic diagram demonstrating production of remaining oil in a bottom water reservoir using a combination of original vertical well injection of non-condensable gas and new horizontal well.
Figure 4:
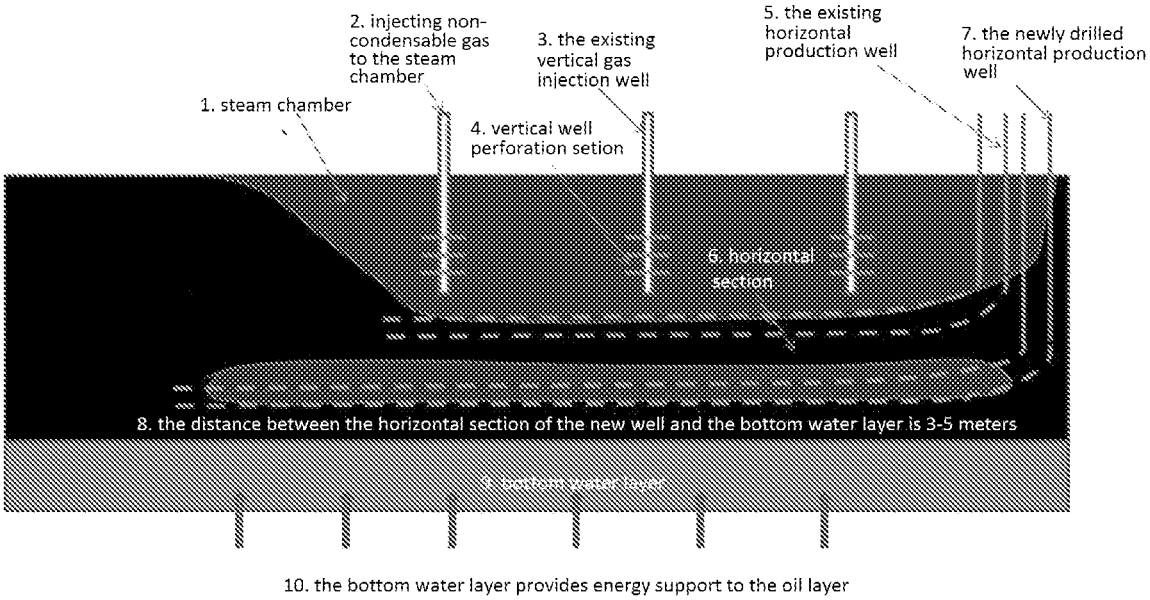
FIG. 4 is a schematic diagram demonstrating production of remaining oil in a bottom water reservoir using a newly drilled vertical well or a combination of an old well and a new horizontal well to conduct air injection (initial stage of production)

In a third step, the method includes, after the horizontal section of the new horizontal well is in thermal communication with the upper steam/gas chamber, converting the new horizontal well into a continuous production well; shutting in the original upper horizontal well when steam/gas chamber is too low. In the initial stage of the production of a horizontal well (as shown in FIG. 4), the pressure of the steam/gas chamber is controlled within the range higher than the pressure of the bottom water layer by 300-500 kPa, in order to push the upper preheated crude oil to the lower horizontal well, and after the stable production is reached, the pressure in the steam/gas chamber is controlled at the balanced pressure level of the bottom water layer.

In a fourth step, the method includes, after the initial stage of the production of the new horizontal well, drilling a new vertical well in the unswept reservoir area, wherein the newly drilled vertical well and the new horizontal well form a new pair of vertical well and horizontal well combination; the distance between the bottom boundary of the perforation well section of the vertical well and the toe level of the horizontal well is 3-5 meters.

In a fifth step, the method includes, forming a fluid communication in the oil layer between the vertical well and the horizontal well by any means of thermal circulation, injection of light oil, injection of chemical solvents, injection of a viscosity reducer, or electric heating, wherein the pressure of the horizontal well is kept equal to the pressure of the bottom water layer during the entire fluid communication process, reducing the risk of bottom water invading a production well and a steam/gas chamber.

Figure 5:
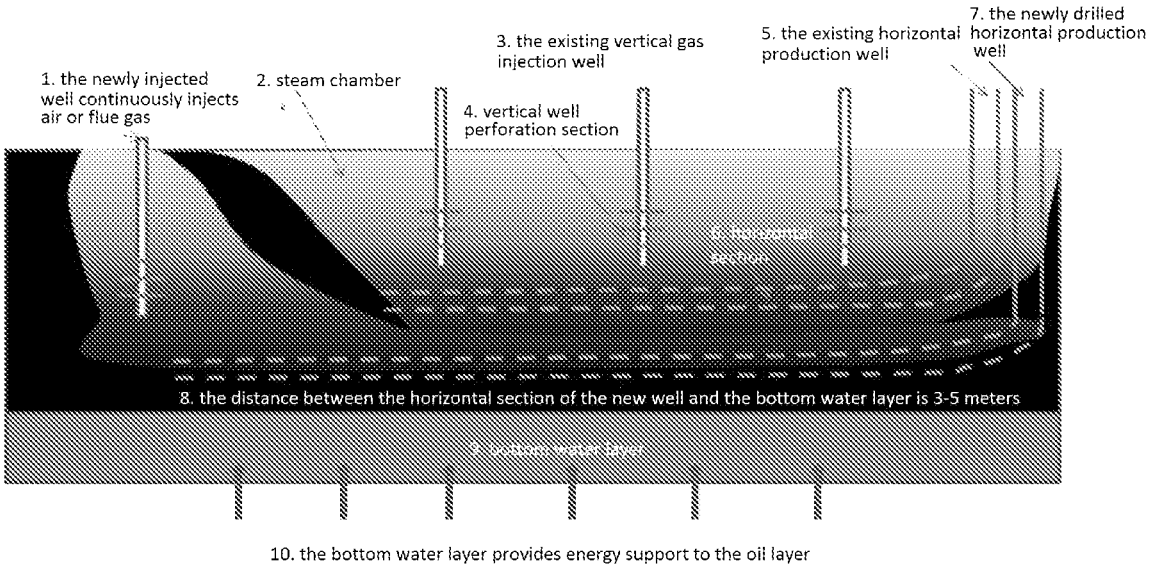
FIG. 5 is a schematic diagram demonstrating production of remaining oil in a bottom water reservoir using a newly drilled vertical well or a combination of an old well and a new horizontal well to conduct air injection (later stage of production).

The method can also include, after the injection and production well forms the communication, injecting air or oxygen into the vertical well, forming the condition for in-situ combustion underground, and producing the heated crude oil and combustion gas from the horizontal well, wherein with the progress of the production process, the steam/gas chamber further expands in the reservoir along the new horizontal well and the vertical well, and produces the remaining oil in the lower part of the crude oil above the new horizontal well and near the toe (as shown in FIG. 5), which greatly improves the ultimate recovery of the oil reservoir;

During the above entire process, the combustion gas generated underground enters the upper steam/gas chamber, which will help increase the pressure in the steam/gas chamber and prevent the bottom water from advancing upward; once the fluid is injected or the horizontal well communicates with the original steam/gas chamber, the upper horizontal well is shut down;

In a sixth step, the method includes, when the horizontal well enters the later stage, stopping gas injection and gradually reducing the pressure in the steam/gas chamber until the end of oil production, wherein due to the high energy of the bottom water layer, due to being driven by the pressure difference between the bottom water layer and the steam/gas chamber, the heated crude oil in the lower part of the horizontal well will be displaced to the production well for production, further increasing the recoverable reserves of the oil layer.

In the present embodiment, there are the initial stage of horizontal well production, the middle stage of the horizontal well production, and the later stage of the horizontal well production.

The initial stage of horizontal well production refers to the period between the time when a newly drilled horizontal well is put into production and the time when the horizontal well cannot be economically produced.

The middle stage of the horizontal well production refers to the period between the time when a new vertical well is drilled and the horizontal well is re-open for production and the time when the re-produced horizontal well cannot be economically produced.

The later stage of the horizontal well production refers to the period between the time when the re-produced horizontal well produces the crude oil in the upper part of the horizontal well to the economic limit and the time when the oil production ends.

The application range of the present embodiment is the heavy oil reservoir with bottom water and (1) an oil layer of more than 10 meters is left behind below the SAGD horizontal production well;

(2) an oil layer of more than 10 meters is left behind below the bottom of perforation interval from vertical well steam huff and puff; and/or (3) due to the geological structure, there is an oil reservoir with a lot of remaining oil left behind below the horizontal production well.

The above description does not limit the present invention in any form. Although aspects of the inventive concepts have been disclosed through the above embodiments, it is not intended to limit the scope of the present invention. Any person skilled in the art can use the above disclosed technical content to make some changes or modifications to equivalent embodiments without departing from the scope of the technical solution of the present invention. As long as the content does not depart from the technical solution of the present invention, any simple modification, equivalent changes, and modifications made to the above embodiments are based on the technical essence of the present invention still falling within the scope of the technical solution of the present invention.

What is claimed is:

1. A method for injecting non-condensable gas or application of in-situ combustion to recover remaining oil in a heavy oil reservoir with bottom water, comprising the following steps:

Step S10: drilling a new horizontal well in an oil layer between an existing horizontal production well location and a top of a bottom water layer;

Step S20: preheating the new horizontal well, wherein during the preheating stage, an operating pressure at a bottom hole of the new horizontal well is equal to a pressure of the bottom water layer to prevent an injected fluid from entering the bottom water layer, including using an existing vertical gas injection well to inject air or flue gas into an existing steam chamber, and increasing a pressure in the steam chamber to be the same as the bottom water pressure;

Step S30: after a horizontal section of the new horizontal well is preheated, converting the new horizontal well into a continuous production well, including shutting in the original upper horizontal well when the steam/gas chamber is too low;

Step S40: after an initial stage of producing from the new horizontal well, drilling a new vertical well in an unswept reservoir area, wherein the newly drilled vertical well and the new horizontal well form a new vertical well and new horizontal well combination;

Step S41: achieving fluid communication in the oil layer between the new vertical well and the new horizontal well;

Step S50: after achieving fluid communication in the oil layer between the new vertical well and the new horizontal well, injecting air or oxygen into the new vertical well to create a combustion condition underground, and producing a heated crude oil and combustion gas from the new horizontal well; and Step S60: when producing from the new horizontal well reaches an economic limit, stopping gas injection and reducing the pressure in the steam/gas chamber until an end of oil production.

2. The method according to claim 1, wherein the horizontal section of the horizontal well in the step S10 is placed in the oil layer having a distance of 2-5 meters above the top of the bottom water layer.

3. The method according to claim 2, wherein in the step S20, preheating is performed by any of steam circulation, electric heating, solvent injecting or the combination thereof.

4. The method according to claim 1, wherein in the step S40, in the initial stage of producing from the new horizontal well, the pressure of the steam/gas chamber is higher than the pressure of the bottom water layer by 300-500 kPa, in order to push the upper preheated crude oil to the lower new horizontal well, and after stable production is reached, the pressure in the steam/gas chamber is controlled at the balanced pressure level of the bottom water layer.

5. The method according to claim 1, wherein the distance between the new vertical well and a toe of the new horizontal well is 5-10 meters in the step S40, and the distance between a bottom of a perforation interval of the new vertical well and the toe level of the new horizontal well is 3-5 meters.

6. The method according to claim 5, wherein in the step S41, the fluid communication is established in the oil layer between the new vertical well and the new horizontal well by any of thermal circulation, injection of light oil, injection of chemical solvents, injection of a viscosity reducer, or electric heating.

7. The method according to claim 6, wherein the pressure of the new horizontal well is kept equal to the pressure of the bottom water layer during the entire fluid communication process, thereby reducing the risk of bottom water invading a production well and the steam/gas chamber.

* * * * *